US005102717A

United States Patent [19]

Butters et al.

[11] Patent Number: 5,102,717

[45] Date of Patent: Apr. 7, 1992

[54] INKABLE SHEET

[75] Inventors: Alan Butters; Graham A. Page, both of Ipswich; Roger N. Barker, Essex, all of England

[73] Assignee: Imperial Chemical Industries PLC, London, England

[21] Appl. No.: 555,733

[22] Filed: Jul. 23, 1990

[30] Foreign Application Priority Data

Jul. 21, 1989 [GB] United Kingdom ..... 8916732

[51] Int. Cl.[5] ..... B41M 5/00

[52] U.S. Cl. ..... 428/195; 346/135.1; 427/146; 428/314.8; 428/500

[58] Field of Search ..... 346/135.1; 427/146; 428/195, 314.8, 500

[56] References Cited

U.S. PATENT DOCUMENTS 4,371,582 2/1983 Sugiyama et al. ..... 428/537

FOREIGN PATENT DOCUMENTS 0156532 10/1985 European Pat. Off. ..... 428/195
0232040 8/1987 European Pat. Off. ..... 428/195
0233703 8/1987 European Pat. Off. ..... 428/195
5706590 7/1984 Japan ..... 428/195
5712105 7/1984 Japan ..... 428/195
5809382 12/1985 Japan ..... 428/195
5900818 6/1986 Japan ..... 428/195

*Primary Examiner*—Pamela R. Schwartz
*Attorney, Agent, or Firm*—Cushman, Darby & Cushman

[57] ABSTRACT

An inkable sheet comprises a substrate and ink-absorbent layer, the surface of which exhibits an internal contact angle of at least 120°. A modifying treatment provides a microporous surface zone of reduced apparent hydrophilicity which accepts a high loading of an aqueous-based ink. Ink patterns of high resolution are thereby achievable.

10 Claims, 1 Drawing Sheet

INKABLE SHEET

BACKGROUND OF THE INVENTION (a) Technical Field of Invention

This invention relates to an inkable sheet, and in particular, to a sheet suitable for use with an automated printing assembly, such as an ink jet printer or a pen plotter.

(b) Background of the Art

With the recent proliferation of micro-computers and colour monitors there has been a rapid growth in the amount of information available for display in colour. Presentation of such information has created a demand for hard copy, for example—on paper sheets, but increasingly on transparent polymeric films which are capable of serving as imaged transparencies for viewing in a transmission mode. Preparation of the desired hard copy is conveniently effected by, for example, an ink jet printer or a pen plotter, using an aqueous or an aqueous-organic solvent-based ink.

Ink jet printing is already established as a technique for printing variable information such as address labels, multi-colour graphics, and the like. A simple form of ink jet printer comprises a capillary tube coupled to an ink reservoir and a piezo-electric element which, on application of a voltage pulse, ejects an ink droplet from the capillary tube at high velocity (e.g. up to 20 $ms^{-1}$) onto an ink receptive sheet. Movement of the ink jet may be computer controlled, and new characters may therefore be formed and printed at electronic speeds. To derive advantage from this high speed operating capability requires the use of an ink-receptive sheet which will quickly absorb the high velocity ink droplet without blotting or bleeding. Although a plastics sheet may be employed, such sheets generally tend to exhibit inferior ink absorption and retention characteristics. In particular, coalescence of adjacent applied ink droplets on the sheet surface tends to yield an applied ink pattern of inferior resolution.

Pen plotter assemblies are extensively used in drawing offices, and particularly in the generation of computer aided designs. The advent of transparent polymeric recording sheets has revealed that the formation thereon of inked images of acceptable quality usually requires the development of special, and expensive pens. Even so, pattern resolution remains a problem.

(c) The Prior Art

Various recording sheets have been proposed for use with ink jet printers. In particular, U.S. Pat. No. 4,474,850 discloses an ink jet recording transparency said to be capable of being wetted by and absorbing coloured, water-soluble inks to provide high density images which are smear resistant, the transparency comprising:

(a) a substantially transparent resinous support, such as a polyester or polyvinyl chloride film, and (b) a substantially clear coating which includes a carboxylated, high molecular weight polymer or copolymer or salts thereof.

The carboxylated polymer or copolymer coating particularly comprises monomers of acrylic or methacrylic acid and esters thereof, vinyl acetates or styrenated acrylics, and usually has a molecular weight of from about 50,000 to 1 million. We have observed that an inked pattern applied to such a film transparency is relatively slow to dry, the ink droplets having a tendency to merge at relatively high loadings, and that such transparencies are particularly susceptible to curling whereby a pattern applied thereto appears distorted when viewed as a transmission image.

GB-A-2175516 discloses an ink jet recording medium comprising a substrate and an ink-receiving layer thereon, the receiving layer comprising a hydrophilic resin and a hydrophobic substance, such as a fatty acid or a salt or ester thereof, which is liquid or waxy at normal temperature. A declared object of the disclosed invention is to provide excellent ink absorptivity and light transmittance and to remove image irregularity even when printed onto an area contaminated by skin fat from the impression of a finger print. Even so, a further improvement in image resolution would be beneficial.

We have now devised an inkable sheet which is particularly suitable as a recording sheet for use with an automated printing assembly, such as an ink jet printer or a pen plotter, and which eliminates or substantially overcomes the aforementioned problems.

SUMMARY OF THE INVENTION

Accordingly, the present invention provides an inkable sheet comprising a substrate having on a surface thereof an ink-absorbent resin layer wherein the surface of the absorbent layer remote from the substrate is such that an aqueous - ethylene glycol - n-methyl-2-pyrrolidone (75:20:5 by weight) droplet deposited thereon exhibits an internal contact angle of at least 120°.

The invention also provides a method of preparing an inkable sheet comprising providing on a surface of a substrate an ink-absorbent resin layer and applying a modifying medium to the ink-absorbent layer to yield an ink-absorbent layer having a surface such that an aqueous - ethylene glycol - n-methyl-2-pyrrolidone (75:25:5 by weight) droplet de an internal contact angle of at least 120°.

DETAILED DESCRIPTION AND PREFERRED EMBODIMENTS OF THE INVENTION

Contact angles referred to herein are average values measured in accordance with ASTM-D 724-45, save that the supply needle is positioned 1 mm from the sheet surface, and the maximum angle is observed when the test fluid is pumped at a rate of 3.6 $\mu$liters $sec^{-1}$.

To absorb and retain an aqueous-based ink, the ink-absorbent layer of a sheet according to the invention is of an essentially hydrophilic nature exhibiting a marked affinity for an aqueous ink. Such layers are known in the art, as hereinafter described, and generally are such that an aqueous - ethylene glycol - n-methyl-2-pyrrolidone (75:25:5 by we deposited on the absorbent surface exhibits an advancing internal contact angle not exceeding about 100°, and is absorbed relatively rapidly into the matrix structure of the absorbent layer.

By treating the surface of the absorbent layer with a modifying medium whereby the aforementioned contact angle is increased to at least 120° relative to the absorbent surface, it has proved possible to reduce the kinetic wetting tendency of the applied aqueous ink medium, thereby limiting the initial spread of individual applied droplets on the absorbent surface and reducing uncontrolled redistribution of droplets under the influence of surface tension, while retaining the rapid absorption characteristics of the absorbent matrix. Interfacial viscosity, involving a viscous interaction between the modified surface and a droplet applied thereto, is believed to contribute to the improved performance.

The maximum theoretical internal contact angle is 180°, although an inkable sheet according to the invention is unlikely to exhibit a value exceeding 175°. An acceptable sheet therefore exhibits an internal contact angle of from 120° to 175°, preferably from 130° to 175°, and particularly from 135° to 175°.

A range of modifiers may be employed in the formulation of a modifying medium for treatment of an ink-absorbent layer in accordance with the invention. These modifiers are suitably of a hydrophilic nature and conveniently comprise materials which are solid at ambient temperature (≈23° C.). A polymeric modifier is particularly suitable, a preferred polymeric modifier exhibiting a low molecular weight less than that of the principal polymeric component of the ink-absorbent layer. A preferred, low molecular weight, non-hydrophobic, polymeric modifier exhibits a molecular weight (number average) not exceeding 100,000, preferably from 5,000 to 100,000, particularly from 7,500 to 50,000, and especially from 9,000 to 15,000.

A blend of two or more modifiers may be employed, a preferred blend comprising a vinyl pyrrolidone polymer and an ethylene oxide polymer, the respective molecular weights (number average) thereof conveniently being in a ratio exceeding 1:1. For example, the respective molecular weights (number average) of the vinyl pyrrolidone polymer and the ethylene oxide polymer are conveniently within the ranges of from 7,000 to 15,000 and from 6,000 to 9,500.

In a modifying medium comprising a blend of modifiers, the respective concentrations of the modifier components may vary over a wide range, but it is generally preferred that the modifier of highest molecular weight should be the principal component of the blend. For example, in a blend comprising two polymeric modifiers, such as a polyvinylpyrrolidone and a polyethylene oxide, that of higher molecular weight is generally present in a percentage concentration by weight of from 55 to 95, preferably from 70 to 90, especially 80, the corresponding percentage concentration of the modifier of lower molecular weight being from 45 to 5, preferably 30 to 10, and especially 20.

The modifying medium is conveniently applied to the ink-absorbent layer by a conventional coating technique—for example by deposition from a solution or dispersion of the modifier(s) in a volatile carrier medium, such as an aqueous and/or organic solvent medium. Methanol and ethanol are suitable organic solvents.

Observations indicate that application of an essentially hydrophilic modifying medium may generate a zone of reduced apparent hydrophilicity, relative to the bulk of the ink-absorbent matrix and at the exposed surface thereof. While residual modifying medium may adhere to the external surface of the absorbent layer as a discrete layer of reduced apparent hydrophilicity (and of thickness not exceeding 1.0 μm, preferably less than 0.5 μm), which may be discontinuous, it appears that the modifying medium may penetrate the absorbent layer, thereby introducing microscopic air inclusions into the surface region thereof. In a preferred embodiment of the invention the ink-absorbent layer therefore comprises an array of micropores extending through the exposed surface and into the bulk of the absorbent layer.

The micropores in the surface zone of reduced apparent hydrophilicity generally exhibit an average diameter of from 0.05 to 0.5 μm, preferably from 0.15 to 0.25 μm, and the pore density distribution of the micropores is such that the area of the ink-absorbent surface occupied by micropores is from 5 to 30%, particularly from 10 to 20%, for example 15%, of the exposed surface. Such surface micropores provide improved pattern resolution without significant detriment to the optical characteristics, particularly haze, of the inkable sheet.

The effect of the zone of reduced apparent hydrophilicity is to increase the contact angle of an applied ink droplet relative to the absorbent surface, thus reducing the area of the ink droplet in contact with the absorbent surface and consequently reducing the tendency of neighbouring ink droplets to coalesce. Thus the area of absorption of the ink droplet is reduced, which might be expected to result in an increase in the required drying time. In addition, the presence of a surface region of reduced apparent hydrophilicity on the ink-absorbent layer might also be expected to reduce the rate of ink absorption into the ink-absorbent layer. Surprisingly this is not the case, and an inkable sheet according to the invention demonstrates a reduced tendency to ink coalescence without a corresponding increase in the required drying time. A practical consequence of the aformentioned property is that the ink loading can be increased, thereby improving image resolution and quality.

The ink-absorbent layer of a sheet according to the invention permits rapid drying of an applied ink pattern, and is desirably such that an aqueous - ethylene glycol (50:50 w/w) -based ink, or similar composition, applied to the surface of a sheet from an ink jet printer will resist off-setting when the inked surface is placed in contact with the surface of a paper sheet within 50 seconds, and preferably within 45 seconds, of application of the ink. Desirably, the applied ink should be absorbed through the surface region of reduced apparent hydrophilicity and into the ink-absorbent layer to an extent such that smudging does not occur within 40 seconds, and preferably within 30 seconds of application of the ink.

The ink-absorbent layer comprises any suitable ink-receptive resin. For example, the ink-absorbent layer conveniently comprises any hydrophilic resin, or a blend of such resins, which can be coated onto the substrate to yield an absorbent layer capable of absorbing and retaining an aqueous-organic ink-solvent medium—for example, by capillary action.

The absorbent layer may comprise voids, such as fissures, cracks, pores, open cells, or the like, having a width or diameter in a range of from 0.001 to 5.0 μm, although it is preferred that the non-inked absorbent layer should be inherently transparent and non-light scattering and therefore comprise voids of width or diameter from 0.001 to 1.0, preferably from 0.001 to 0.75, and, particularly preferably from 0.01 to 0.05 μm. The aspect ratio (i.e. length:width) of the voids may vary over a wide range, but is typically from 1 to 1000, for example—from 4 to 400, and especially from 20 to 100.

A voided ink-absorbent resin layer may be prepared by a variety of methods. Thus, a film substrate may be coated with a formulation comprising a colloidal dispersion in a volatile carrier medium—for example, a coacervate of a polyacid and a polybasic material. Alternatively, a blend of incompatible polymers may be deposited from a mutual solvent. In another method, a polymer may be deposited on a substrate from a blend of solvents such that the least volatile and slower evaporating solvent has poor solvency for the absorbent resin. Step-wise drying of a deposited polymer layer may also be employed to yield the desired porous structure.

Suitable resins for the production of an essentially hydrophilic ink-absorbent layer in accordance with the invention include cellulosics, such as nitrocellulose, ethylcellulose and hydroxyethylcellulose: gelatins: vinyls, such as polyvinylacetate, polyvinylchloride, and copolymers of vinyl chloride and vinyl acetate: acrylics, such as polyacrylic acid: and polyvinylpyrrolidones, as described in EP-A-0156532, EP-A-0232040 and EP-A-0233703.

A vinyl pyrrolidone polymer, if employed in the ink-absorbent layer, may comprise a homopolymer or copolymer—for example, with a copolymerisible monomer such as vinyl acetate. A suitable vinyl pyrrolidone polymer will exhibit a molecular weight exceeding that of the principal component of the modifying medium, and generally in excess of about 100,000, preferably from 250,000 to 500.000.

The ink-absorbent resin may comprise a vinyl pyrrolidone polymer and an ester of cellulose containing free carboxylic acid groups. The cellulose ester containing free carboxylic acid groups conveniently comprises an ester of cellulose with a polybasic carboxylic acid or a mixed ester of cellulose derived from at least one polybasic carboxylic acid, the resulting cellulose ester containing free carboxylic groups, as described in EP-A-0198636.

However, a preferred ink-absorbent layer comprises a vinyl pyrrolidone polymer and an acrylic or methacrylic polymer, as described in EP-A-0233703. A particularly suitable acrylic or methacrylic polymer for use in conjunction with a vinyl pyrrolidone polymer, has an acid number (mg KOH per g) not exceeding 150, and preferably of from 20 to 120, for example—a copolymer of methacrylic acid and methyl methacrylate with an acid number (mg KOH per g) of from about 60 to 100, particularly about 80. The relative proportions of the respective components in such an ink-absorbent layer may be varied within wide limits, although it is preferred that the vinyl pyrrolidone polymer comprises the major polymeric component, preferably from at least 50 to 85%, and especially from 60 to 75% by weight of the resin layer. A particularly preferred ink-absorbent layer comprises (a) a vinyl pyrrolidone polymer, and (b) an acrylic or methacrylic polymer in a weight ratio of about 7:3.

If desired, the ink-absorbent resin may comprise a plasticiser, that is any additive which may be incorporated into a polymeric material to improve its softness, processability and flexibility. They are well known per se in the plastics art, particularly for modifying the characteristics of polyvinyl chloride, and are usually organic materials in the form of moderately high molecular weight liquids or low melting solids. Most commonly they comprise esters of carboxylic acids or phosphoric acid, although hydrocarbons, halogenated hydrocarbons, ethers, glycols, polyglycols and hydrogenated or epoxydised drying oils (e.g. soya bean oil) may also be employed, as described in EP-A-0232040.

To improve the ageing behaviour of the ink-absorbent resin layer and promote absorption and drying of a subsequently applied ink, a surfactant may, if desired, be incorporated into the resin layer. Suitable surfactants include a non-ionic, fluorocarbon surfactant or a cationic surfactant , such as a quaternary ammonium salt. Additionally a humectant, such as glycerol, may be employed.

If desired, the ink-absorbent layer may additionally comprise a particulate filler to improve the handling characteristics of the sheet. Suitable fillers include oxides of metals or metalloids, such as silica, desirably of a particle size not exceeding 20, and preferably less than 12, for example 8 μm. The amount of filler employed will be dictated by the desired characteristics of the sheet but will generally be low to ensure that the optical characteristics (such as haze) of the sheet remain unimpaired. Typical filler loadings are of the order of less than 2.0, and preferably from 0.5 to 1.0% by weight of the resin component(s}.

The ink-absorbent layer is conveniently applied to the substrate by a conventional coating technique—for example, by deposition from a solution or dispersion of the resin(s) in a volatile medium, such as an aqueous or organic solvent medium.

Drying of the applied ink-absorbent resin layer may be effected by conventional drying techniques—for example, by suspending the coated substrate in a hot air oven maintained at an appropriate temperature. A drying temperature of about 120° C. is usually suitable for a polyester substrate.

The thickness of the dry ink-absorbent resin layer may vary over a wide range, but is conveniently within a range of from 2 to 25, and preferably from 5 to 20, for example 15 μm.

A substrate for use in the production of an inkable sheet according to the present invention suitably comprises any polymeric material capable of forming a self-supporting opaque, or preferably transparent, film or sheet.

By a self-supporting film or sheet is meant a film or sheet capable of independent existence in the absence of a supporting base.

Suitable thermoplastics materials for use in the production of a substrate include a cellulose ester, e.g. cellulose acetate, polystyrene, a polymer and copolymer of vinyl chloride, polysulphone, a homopolymer or copolymer of a 1-olefine, such as ethylene, propylene and but-1-ene, a polyamide, a polycarbonate, and, particularly, a synthetic linear polyester which may be obtained by condensing one or more dicarboxylic acids or their lower alkyl (up to 6 carbon atoms) diesters, e.g. terephthalic acid, isophthalic acid, phthalic acid, 2,5-2,6- or 2,7-naphthalenedicarboxylic acid, succinic acid, sebacic acid, adipic acid, azelaic acid, 4,4'-diphenyldicarboxylic acid, hexahydroterephthalic acid or 1,2-bis-p-carboxyphenoxyethane (optionally with a monocarboxylic acid, such as pivalic acid) with one or more glycols, particularly an aliphatic glycol, e.g. ethylene glycol, 1,3-propanediol, 1,4-butanediol, neopentyl glycol and 1,4-cyclohexanedimethanol. A polyethylene terephthalate film is particularly preferred, especially such a film which has been biaxially oriented by sequential stretching in two mutually perpendicular directions, typically at a temperature in the range 70° to 125°, and preferably heat set, typically at a temperature in the range 150° to 250°, for example as described in GB-A-838708.

The substrate may also comprise a polyarylether or thio analogue thereof, particularly a polyaryletherketone, polyarylethersulphone, polyaryletheretherketone, polyaryletherethersulphone, or a copolymer or thioanalogue thereof. Examples of these polymers are disclosed in EP-A-1879, EP-A-184458 and U.S. Pat. No. 4,008,203, particularly suitable materials being those sold by ICI PLC under the Registered Trade Mark STABAR. Blends of these polymers may also be employed.

Suitable thermoset resin substrate materials include addition—polymerisation resins—such as acrylics, vinyls, bis-maleimides a unsaturated polyesters, formaldehyde condensate resins—such as condensates with urea, melamine or phenols, cyanate resins, functionalised polyesters, polyamides or polyimides.

The substrate is suitably of a thickness from 25 to 300, particularly from 50 to 175, and especially from 75 to 125 μm.

To promote adhesion of the ink-absorbent layer to a polymeric substrate, it is desirable first to treat a surface of the substrate with a priming medium. Creation of a priming layer is conveniently effected by treating a surface of the polymer substrate with an agent known in the art to have a solvent or swelling action on the substrate polymer. Examples of such conventional agents, which are particularly suitable for the treatment of a polyester substrate, include a halogenated phenol dissolved in a common organic solvent e.g. a solution of p-chloro-m-cresol, 2,4-dichlorophenol, 2,4,5- or 2,4 6-trichlorophenol or 4-chlororesorcinol in acetone or methanol. In addition, and preferably, the priming solution may contain a partially hydrolysed vinyl chloride-vinyl acetate copolymer. Such a copolymer conveniently contains from 60 to 98% of vinyl chloride, and from 0.5 to 3% of hydroxyl units, by weight of the copolymer. The molecular weight (number average) of the copolymer is conveniently in a range of from 10,000 to 30,000, and preferably from 16,500 to 25,000.

If desired, a plurality of priming layers may be sequentially applied to a substrate.

The priming agent is suitably applied at a concentration level which will yield a priming layer having a relatively thin dry coat thickness - for example, generally less than 2, and preferably less than 1 μm.

An additional backing layer may be applied to the second (i.e. uncoated) surface of the substrate to improve the machine-handling properties and reduce curling of the inkable sheet. The backing layer may comprise any of the materials suitable for the formation of the ink-absorbent layer, and preferably comprises a filler, particularly of the kind hereinbefore described. The filler loading in the backing layer is generally less than 2% by weight of the resin component(s}, and is preferably less than that of the ink-absorbent layer, for example from 0.1 to 0.5% by weight.

The adhesion of the backing layer to the base sheet may be improved by first treating the surface of the base sheet with a priming medium as hereinbefore described. Priming media which are suitable for improving the adhesion of the ink-absorbent layer to the base sheet may also be used with the backing layer.

An inkable sheet according to the present invention is particularly suitable for use in the preparation of inked transparencies for use in a transmission mode, for example—with an overhead projector. Retention in the ink-absorbing resin layer of the solvent medium of an applied ink ensures rapid drying of the ink, and facilitates immediate use of the imaged sheet.

BRIEF DESCRIPTION OF THE DRAWINGS

The invention is illustrated by reference to the accompanying drawings in which.

Figure 1:
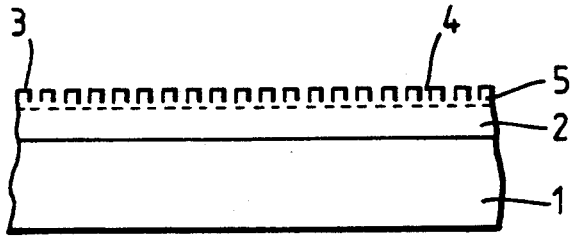
FIG. 1 is a schematic elevation (not to scale) of a portion of an inkable sheet comprising a substrate layer (1) to one surface of which is bonded an ink-absorbent resin layer (2). The exposed surface (3) of the absorbent layer has been treated with a modifying medium to provide an array of micropores (4) in a surface zone (5)
Figure 2:
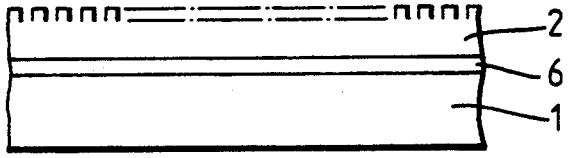
FIG. 2 is a fragmentary schematic elevation of a similar sheet in which the ink-absorbent resin layer (2) is bonded to the substrate layer (1), by an intermediate priming layer (6)
Figure 3:
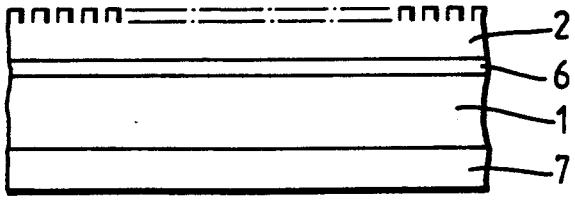
FIG. 3 is a fragmentary schematic elevation of a similar sheet in which an additional backing layer (7) is bonded to the second surface of the substrate layer (1).

The invention is further illustrated by reference to the following Examples.

EXAMPLE 1

One surface of a biaxially oriented, uncoated, polyethylene terephthalate film substrate of about 100 μm thickness was primed with a solution in acetone of p-chloro-m-cresol (3.75% weight/volume) and VINYLITE VAGH (0.75% wt/vol). VINYLITE VAGH is a copolymer of vinyl chloride (90 wt %) and vinyl acetate (4 wt %) with 2.3 wt % hydroxyl content and of average molecular weight 23,000.

The primed substrate was then dried in a hot air oven maintained at a temperature of 80° C. to leave a residual prime layer of approximately 0.2 μm thickness.

The primed surface was then coated with a 15% wt/vol mixture of the following materials in a solvent mixture of methanol:methyl cellosolve:ethanol (89:7:4) :-

| | |
|---|---|
| Polyvinylpyrrolidone, PVP-K90 (molecular weight; 360,000) | 69.00 wt % |
| Hydroxylated, carboxylated acrylic, DP6-2976 (molecular weight; 60,000) | 29.57 wt % |
| Melamine formaldehyde, Cymel 300 | 0.99 wt % |
| Para toluene sulphonic acid | 0.05 wt % |
| Silica, Gasil EBC (average particle size of 8 μm) | 0.39 wt % |

and the coated substrate was dried at a temperature of 120° C. to yield an ink-absorbent resin layer of approximately 13 μm thickness. (PVP-K90 is supplied by GAF(GB) Ltd.).

The ink-absorbent layer was then treated with a modifying mediun comprising a 2 wt % dispersion of the following materials in methanol:-

| | |
|---|---|
| Polyvinylpyrrolidone, PVP-K15 (molecular weight; 10,000) | 80.0 wt % |
| Polyethylene oxide, Pluriol 9000 (molecular weight; 9,000) | 20.0 wt % |

and the coated sheet was dried at a temperature of 120° C. to yield a microporous surface zone of approximately 0.4 μm thickness (PVP-K15 is supplied by GAF(UK) Ltd.).

The advancing internal contact angle of an aqueous - ethylene glycol - n-methyl-2-pyrrolidone (75:20:5 by weight) droplet on zone was determined by the hereinbefore described technique to be 140°.

Characters printed onto the modified surface of the absorbent layer using a high loading of Canon FP510 printer ink was smudge resistant within 30 seconds of printing. Resolution of the characters was excellent.

EXAMPLE 2

This is a comparative Example not according to the invention. The procedure of Example 1 was repeated except that the modifying treatment was omitted.

The advancing internal contact angle of an aqueous - ethylene glycol - n-methyl-2-pyrrolidone (75:20:5 by weight) droplet on the layer, determined as in Example 1, was observed to be 115°.

Characters printed onto the ink-absorbent layer of the sheet, using a high loading of Canon FP51o printer ink had a poor resolution due to coalescing of the individually printed ink droplets.

We claim:

1. An inkable sheet comprising a substrate having on a surface thereof an ink-absorbent resin layer, the surface of the ink-absorbent resin layer remote from the substrate including a hydrophilic polymeric modifier which is solid at ambient temperature and such that an aqueous - ethylene glycol - n-methyl-2-pyrrolidone droplet, 75:20:5 by weight, deposited thereon exhibits an internal contact angle of at least 120°, the polymeric modifier having a number average molecular weight less than that of the principal resin component of said layer and not exceeding 100,000.

2. An inkable sheet according to claim 1 wherein the surface of the ink-absorbent layer remote from the substrate exhibits a zone of apparent hydrophilicity less than that of the absorbent layer per se.

3. An inkable sheet according to any one of the previous claims wherein said remote surface comprises an array of micropores.

4. An inkable sheet according to claim 3 wherein the average diameter of the micropores is from 0.05 to 0.5 μm.

5. An inkable sheet according to claim 4 wherein the micropores occupy from 5 to 30% of the area of said remote surface.

6. An inkable sheet according to claim 5 wherein the polymeric modifier comprises a first vinylpyrrolidone polymer.

7. An inkable sheet according to claim 6 wherein the ink-absorbent layer comprises a second vinyl pyrrolidone polymer of number average molecular exceeding that of the first.

8. An inkable sheet according to claim 6 wherein the ink-absorbent layer comprises a copolymer of acrylic acid or methacrylic acid.

9. An inkable sheet according to claim 2 wherein said zone comprises a discrete layer on the surface of the absorbent layer.

10. A method of preparing an inkable sheet comprising providing on a surface of a substrate an ink-absorbent resin layer, characterised by applying a modifying medium to the ink-absorbent layer to yield an ink-absorbent layer having a surface such that an aqueous - ethylene glycol - n-methyl-2-pyrrolidone droplet, 75:20:5 by weight, deposited thereon exhibits an internal contact angle of at least 120°, the modifying medium comprising a hydrophilic polymeric modifier which is solid at ambient temperature having a number average molecular weight less than that of the principal resin component of the layer and not exceeding 100,000.

* * * * *